US011420350B2

(12) United States Patent
Bittencourt et al.

(10) Patent No.: US 11,420,350 B2
(45) Date of Patent: Aug. 23, 2022

(54) SHAVING CARTRIDGE WITH ENHANCED RINSABILITY

(71) Applicant: SUPER-MAX PERSONAL CARE PVT. LTD., Thane (IN)

(72) Inventors: Antonio Carlos Acatauassu Bittencourt, Curitiba Parana (BR); Yogesh Humbirrao Mohite, Pune (IN)

(73) Assignee: SUPER-MAX PERSONAL CARE PVT. LTD., Thane (IN)

( * ) Notice: Subject to any disclaimer, the term of this patent is extended or adjusted under 35 U.S.C. 154(b) by 0 days.

(21) Appl. No.: 16/618,122

(22) PCT Filed: May 5, 2018

(86) PCT No.: PCT/IN2018/050278
§ 371 (c)(1),
(2) Date: Nov. 28, 2019

(87) PCT Pub. No.: WO2019/003241
PCT Pub. Date: Jan. 3, 2019

(65) Prior Publication Data

US 2020/0198160 A1 Jun. 25, 2020

(30) Foreign Application Priority Data

Jun. 26, 2017 (IN) ..... 201621044497

(51) Int. Cl.
*B26B 21/22* (2006.01)
*B26B 21/40* (2006.01)

(52) U.S. Cl.
CPC ..... *B26B 21/222* (2013.01); *B26B 21/4025* (2013.01); *B26B 21/4031* (2013.01)

(58) Field of Classification Search
CPC ..... B26B 21/222; B26B 21/4031; B26B 21/4025
See application file for complete search history.

(56) References Cited

U.S. PATENT DOCUMENTS 4,016,648 A * 4/1977 Chen ..... B26B 21/222 30/47
4,146,958 A * 4/1979 Chen ..... B26B 21/222 30/47
4,403,412 A * 9/1983 Trotta ..... B26B 21/227 30/47
4,693,003 A * 9/1987 Ferraro ..... B26B 21/225 30/50

(Continued)

*Primary Examiner* — Hwei-Siu C Payer
(74) *Attorney, Agent, or Firm* — Dave Law Group LLC; Raj S. Dave

(57) ABSTRACT

The present invention relates to razor cartridge with a multifunctional seat that is attachable to a handle, plurality of blades without the spacers and a multifunctional cap obviating the use of spacers in between blades. The multifunctional seat provided with protrusions/selective seat and multifunctional cap with corresponding provisions to hold respective blade on the seat enables to dispose plurality of blades parallelly with respect to each other without the use of spacers and yet holding the blades rigidly in their predisposed positions during shaving and providing flushing channels for cleaning of the shaving debris during rinsing of the cartridge after shaving.

30 Claims, 9 Drawing Sheets

(56) References Cited

U.S. PATENT DOCUMENTS

Figure 2A:
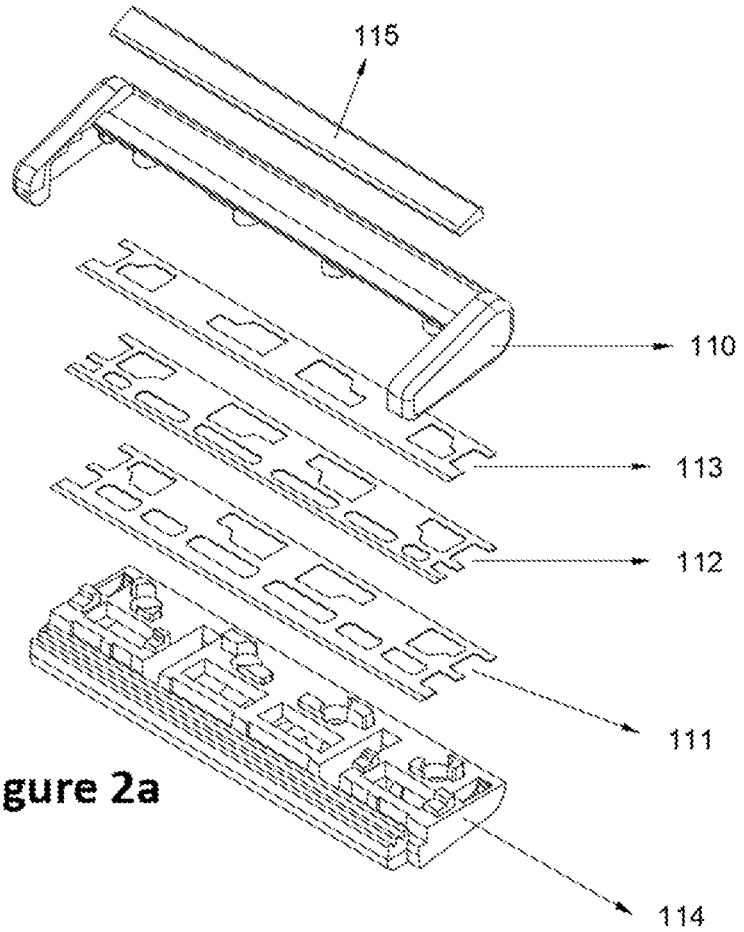

| | | | | | |
|---|---|---|---|---|---|
| 5,070,612 | A * | 12/1991 | Abatemarco | B26B 21/4018 | 30/50 |
| 5,526,567 | A * | 6/1996 | Carson, III | B26B 21/222 | 30/50 |
| 5,557,851 | A * | 9/1996 | Ortiz | B26B 21/227 | 30/50 |
| 5,794,343 | A * | 8/1998 | Lee | B26B 21/4012 | 30/50 |
| 7,191,523 | B2 * | 3/2007 | Miyazaki | B26B 21/222 | 30/50 |
| 2020/0198160 | A1 * | 6/2020 | Bittencourt | B26B 21/4025 | |

* cited by examiner

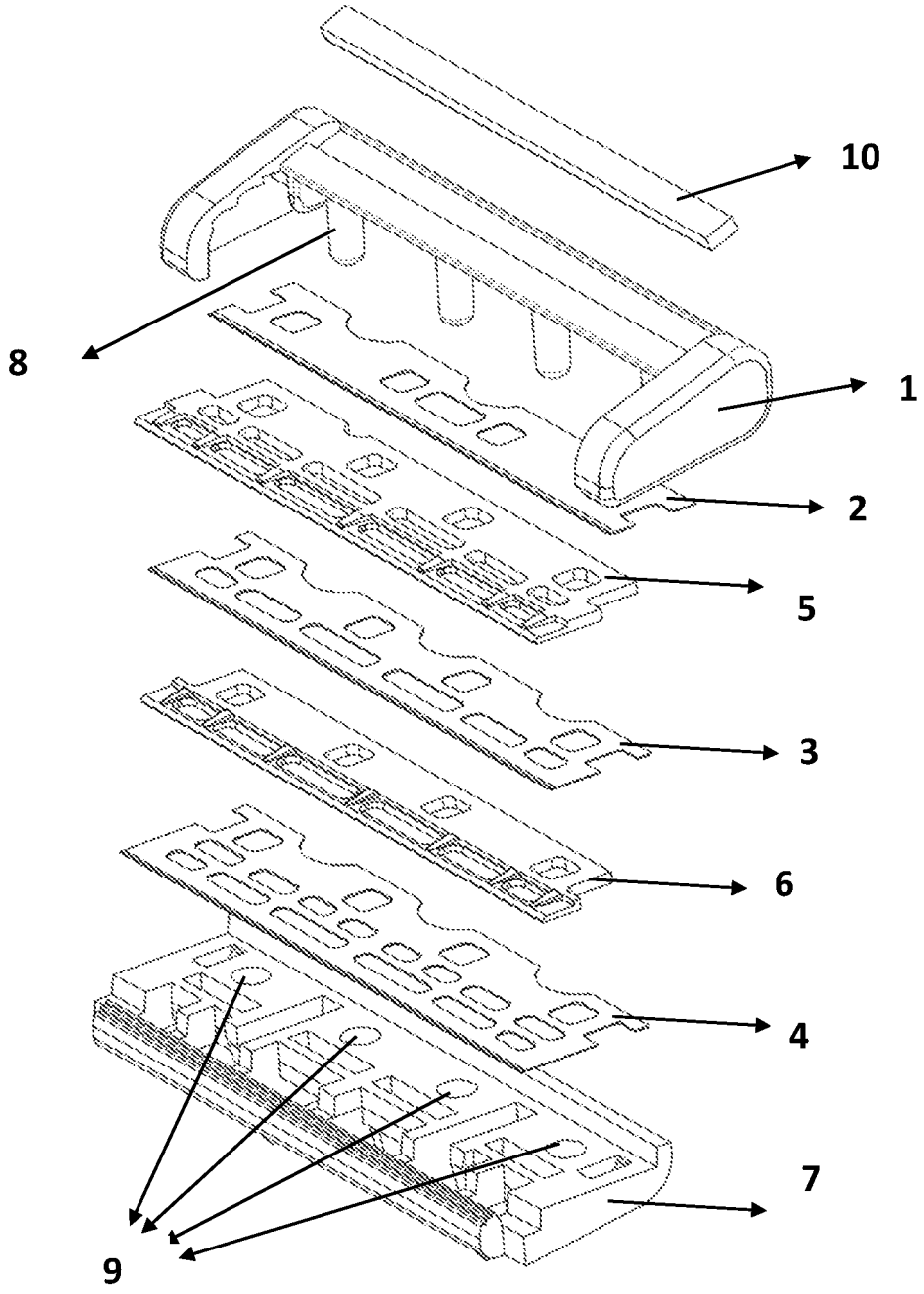
Figure 1 (Prior art depicting typical 3 blade cartridge)

SHAVING CARTRIDGE WITH ENHANCED RINSABILITY

CROSS-REFERENCE

The present application is the U.S. national stage of International Patent Application No. PCT/IN2018/050278, May 5, 2018, which claims the benefit of priority to Indian patent application No. 201621044497, filed on Jun. 26, 2017, the entire disclosures of which are incorporated herein by reference as part of the present application.

FIELD OF INVENTION

The present invention relates to a shaving razor. In particular, the present invention relates to razor cartridge with a multifunctional seat that is attachable to a handle, plurality of blades without the spacers and a multifunctional cap obviating the use of spacers in between blades.

BACKGROUND OF THE INVENTION

The shaving cartridges use multiple blades for effective shaving. The multiple blades have to be parallel to each other and rigidly clamped with each other. To achieve this there is requirement of a spacer in between two blades. This limits ability to accommodate larger number of blades in the limited vertical space in the cartridge. There is disadvantage of these spacers as they block debris generated during shaving. This debris contains shaving foam/cream and hair. Good shaving cartridges should have good rinsability to clean this debris which is composed basically of hair, shaving foam and skin exfoliated during shaving.

Prior art has cartridges with stacked blades with spacers. The present invention provides cartridges having multiple blades without the use of spacers.

Following is the relevant prior art:

The U.S. Pat. No. 6,430,818 discloses the shaving cartridge including a platform member having a blade seat, and a guard member located forward of and parallel to the blade seat so as to form a longitudinal slot between the blade seat and the guard member. A first blade is disposed on the blade seat such that the cutting edge of the blade is located rearwardly of the guard member. A spacer is located on the upper surface of the first blade. The spacer includes an upper surface having a plurality of protruding members extending therefrom and extending through apertures on a second blade such that the second blade is disposed on the upper surface of the spacer. The first blade has apertures that allow debris to flow between the first and second blades and downward through the aperture in the first blade and out through the platform member. A third blade is disposed on an upper surface of the protruding members of the spacer, thereby forming a gap defined by the second and third blades. The blade cartridge also includes a cap member having staking pins extending downwardly therefrom which are used to permanently affix the blade seat, blades, spacer, and cap member together.

The U.S. Pat. No. 3,724,070 discloses the conventional razor with spacers including a platform member connected to a cap member with blade means disposed there between. The blade means comprises a plurality of blade members having cutting edges extending in the same direction, whereby in a shaving operation all the cutting edges are utilized substantially simultaneously.

The U.S. Pat. No. 5,661,907 discloses a razor blade assembly for mounting on a handle via a pivotal connection, the assembly including a housing that carries three blade members, each having leading edges, and has a guard portion, a cap structure, and arcuate bearing surfaces below the blade carrying portion that pivotally engage shell bearing connections of the handle.

The prior art suffers from the following limitations:

- The use of spacers creates obstructions in between blade and in longitudinal direction resulting in negatively affecting rinsability.
- The complexity in construction and number of spacers poses a challenge to manufacture
- It is not riveted cartridges (as disclosed in U.S. Pat. No. 5,661,907)

There is an unmet need to provide shaving cartridge comprising plurality of blades parallelly disposed with respect to each other without the use of spacers and yet holding the blades rigidly in their predisposed positions during shaving and providing flushing channels for cleaning of the shaving debris during rinsing of the cartridge after shaving.

SUMMARY OF THE INVENTION

The main object of the invention is to provide a shaving razor cartridge without the use of spacers. Further object of the invention is to provide a shaving razor cartridge with a multifunctional seat attachable to a handle, a plurality of blades and a multifunctional cap, obviating the use of spacers in between the blades.

Another object of the invention is to provide a multifunctional seat provided with protrusions/selective seat and a multifunctional cap with corresponding provisions to hold respective blade on the seat.

Yet another object of the invention is to provide protrusions on the said multifunctional seat and corresponding protrusions on the multifunctional cap that enable substantially parallel disposition of the blades without the use of spacers.

Yet another object of the invention is to provide said protrusions on the multifunctional seat and corresponding protrusions on the multifunctional cap to enable substantially enhance area available for flushing debris.

Yet another object of the invention is to provide the respective protrusions and resting surface area of the protrusion for respective blade in a manner to provide rigid support to the respective blades yet provide area for flushing the debris.

Yet another object of the invention is to provide the said protrusions that are integrated with the seat and corresponding protrusions on the multifunctional cap.

Yet another object of the invention is to provide attachable respective protrusions for the respective blades wherein the said protrusions are attached to the seat.

Yet another object of the invention is to provide attachable respective protrusions for the respective blades wherein the said protrusions are attached to the multifunctional cap.

Yet another object of the invention is to provide the compressible protrusions having compression enabling action to enable floating blade arrangement.

Yet another object of the invention is to provide a spring loaded protrusions to enable floating blade arrangement.

Yet another object of the invention is to provide height adjustable respective protrusions for respective blades.

Yet another object of the invention is to provide the said protrusions of different material than the said material of construction of the seat.

Yet another object of the invention is to provide a multifunctional seat that is attachable to a handle.

Yet another object of the invention is to provide blades with respective insertion cavities/slots.

Yet another object of the invention is to provide at least two blades.

Yet another object of the invention is to provide three blades.

Yet another object of the invention is to provide more than three blades.

Thus, in accordance with the invention, multifunctional seat, plurality of blades, a multifunctional cap obviating the use of spacers in between blades.

The multifunctional seat comprises of a substantially rectangular shaped platform that has substantially flat surface contoured due to rectangular openings which are in longitudinal direction and rectangular openings, and which are in transverse direction, the flat surface is the first seat for the first blade, a selective seat for the second blade is in the form of a first set of protrusions, a selective seat for the third blade in the form of a second set of protrusions.

A multifunctional cap is comprised of stacking pins, protrusions corresponding to the said first and second set of protrusions provided on the said multifunctional seat;

blades provided with a set of apertures that coincide and provides an opening to receive the respective seat of protrusions.

Wherein the said multifunctional seat in combination with a multifunctional cap eliminates need of spacers.

Another aspect of the invention is to provide a multifunctional seat with respective protrusions for respective blades to enable dispose the blades substantially parallel at a predefined distance to enable effective flushing of debris.

In another aspect of the invention, the said multifunctional seat is integrated with the handle. In another aspect of the invention, the said multifunctional seat is attached to the handle in a manner that it can swivel as per the contour during shaving.

In another aspect of the invention, the said multifunctional seat is configured to receive and substantially parallelly dispose two, three or more than three blades.

In another aspect of this invention is to enable position of blade should be as per desired geometry of shaving without disturbing it.

DESCRIPTION OF THE INVENTION

Features and advantages of this invention will become apparent in the following detailed description and the preferred embodiments with reference to the accompanying drawings.

FIG. 1 Conventional Cartridge with Spacers (Sheet 1)

FIG. 2*a* Cartridge with the Multifunctional Seat and Multifunctional Cap (Sheet 2)

Figure 2B:
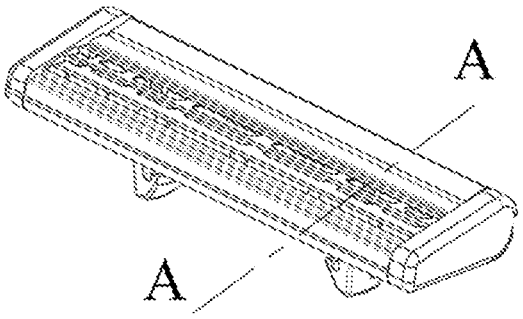

FIG. 2*b* Cartridge (Sheet 2)

Figure 3:
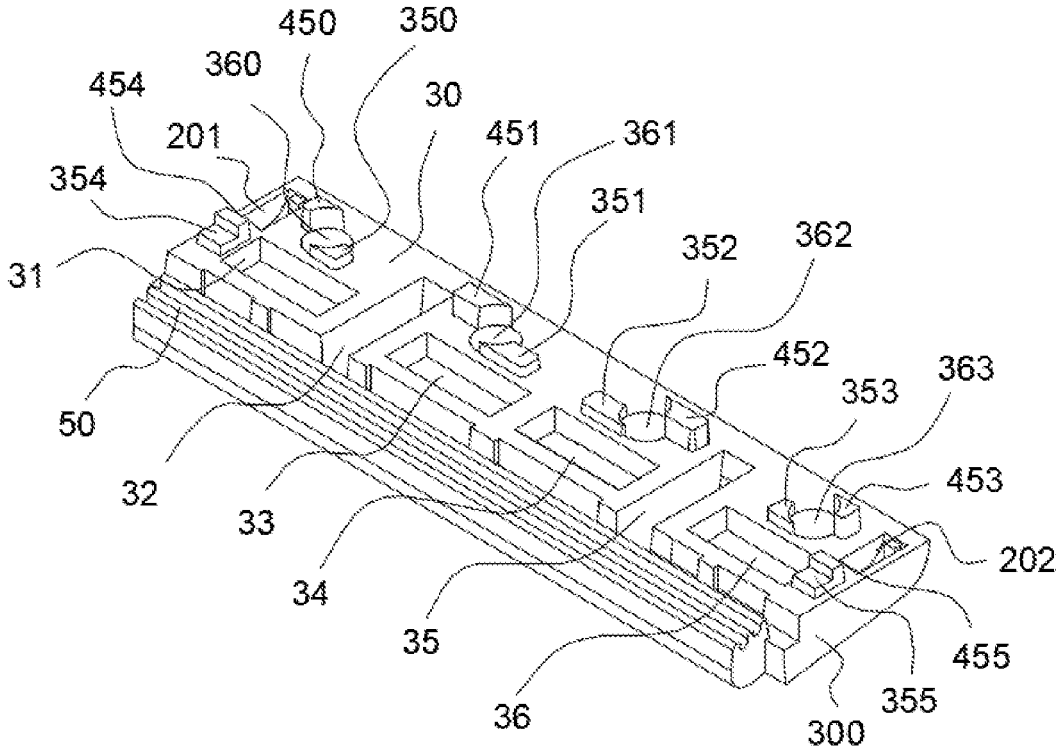

FIG. 3 Multifunctional Seat (Sheet 3)

Figure 3A:
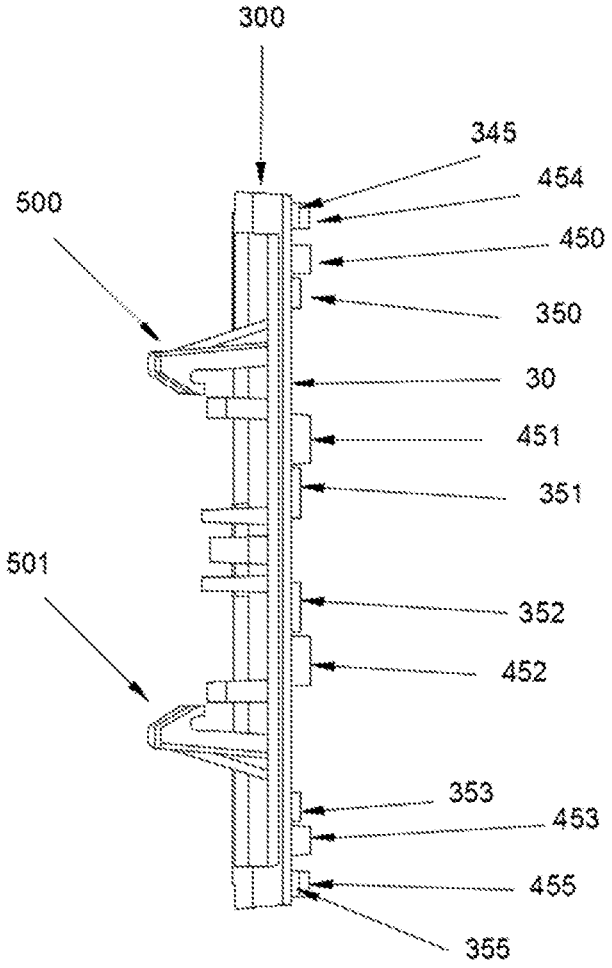

FIG. 3*a* Side view of the Multifunctional Seat 114 (Sheet 4)

Figure 4:
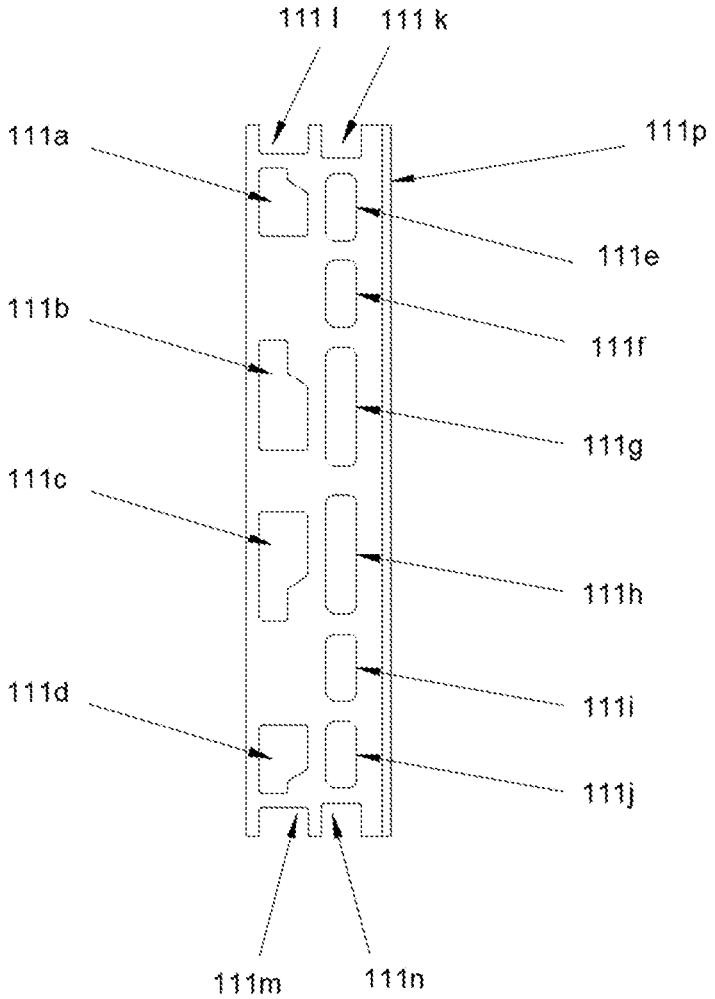

FIG. 4 First Blade (Sheet 5)

Figure 5:
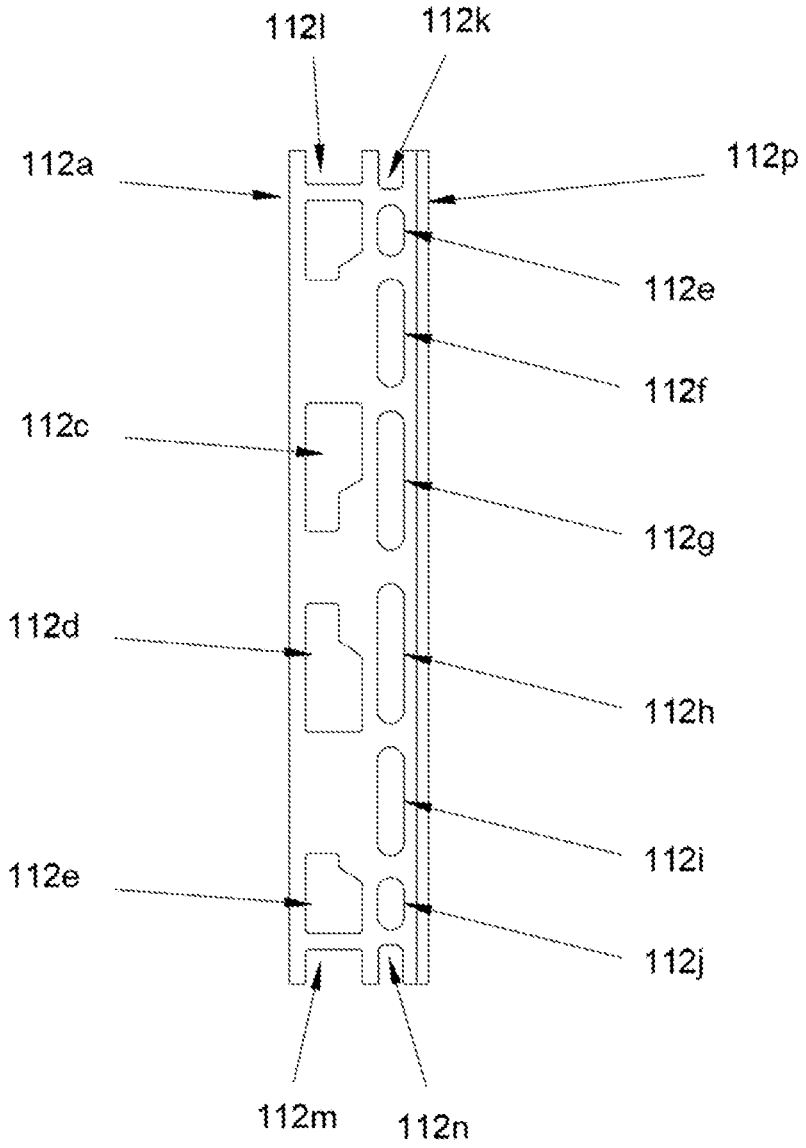

FIG. 5 Second Blade (Sheet 6)

Figure 6:
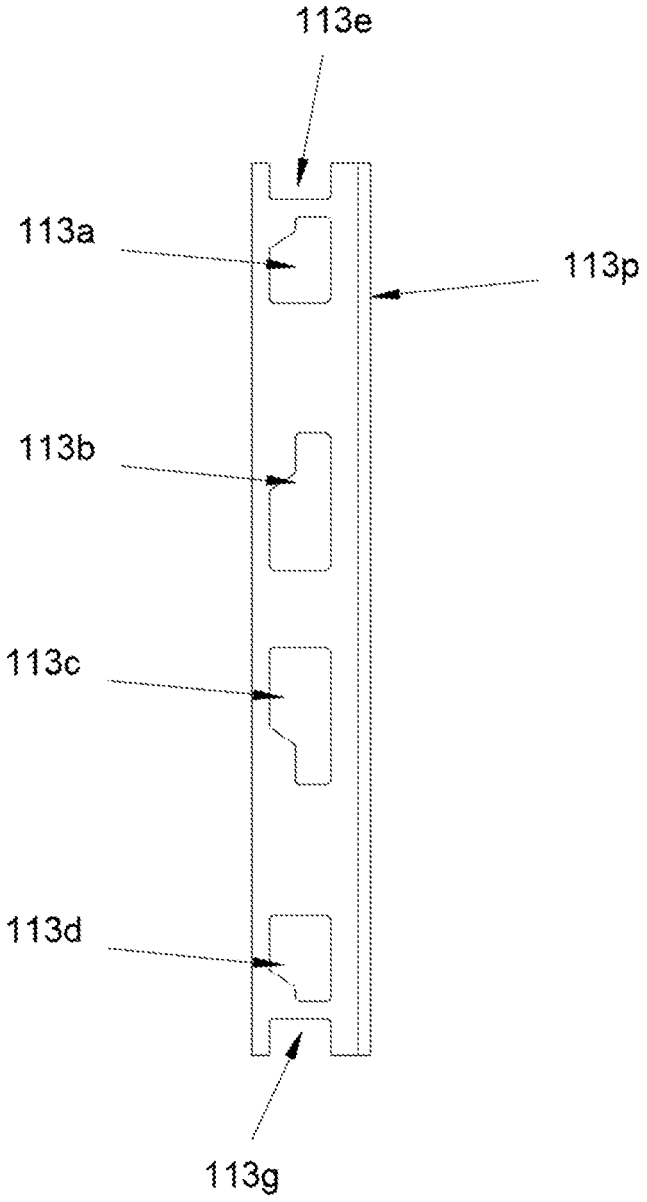

FIG. 6 Third Blade (Sheet 7)

Figure 7:
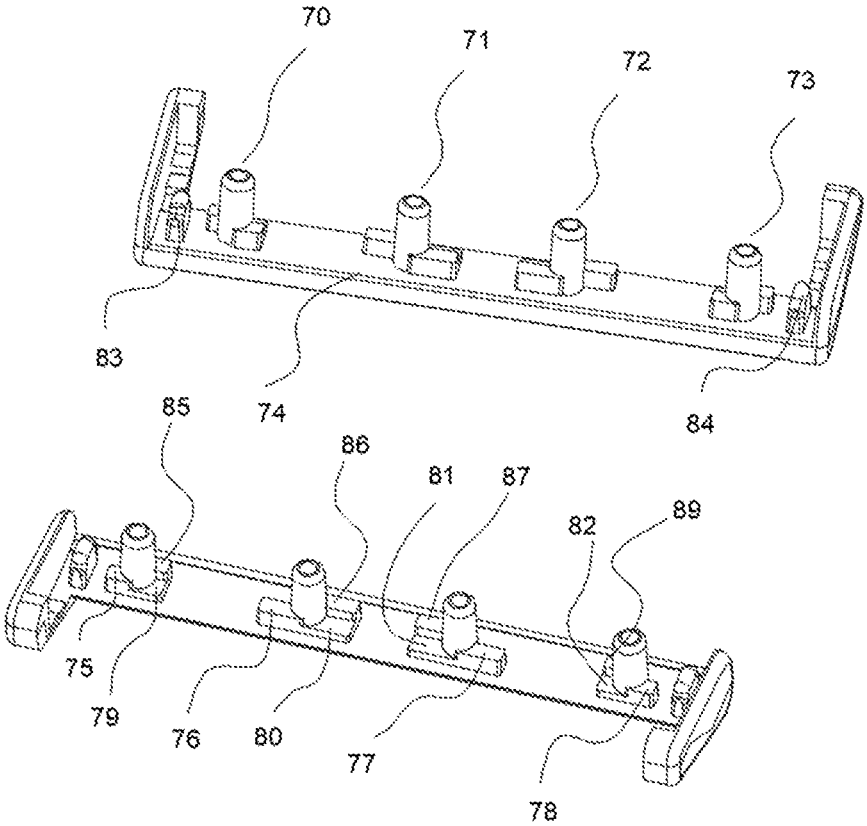

FIG. 7 Multifunctional Cap 110 (Sheet 8)

Figure 8:
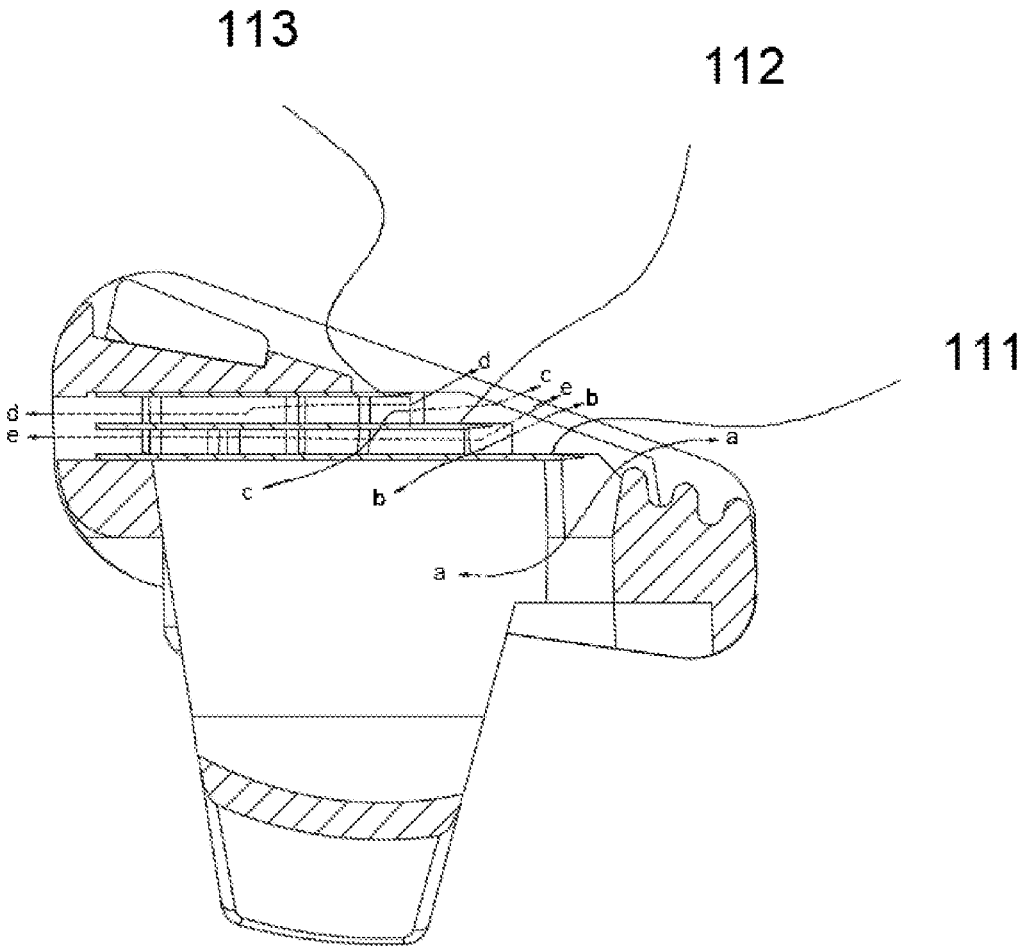

FIG. 8 Section view AA showing Debris flow path between the blades (Sheet 9)

The conventional cartridge with three blades is depicted in FIG. 1. It comprises of a seat 7 and blades 2, 3 and 4. The spacers 5 and 6 that are in the form of a lamina as illustrated in the FIG. 1 are provided in between the said blades. The blades and spacers are placed on a stacking pin 8 and at seat 7 wherein the stacking pin 8 is engaged in holes 9 on the seat 7. The blades cut hair off the skin and the debris comprising of, hair, shaving cream/foam, skin etc., needs to be flushed off for effective shaving. The spacers 5 and 6 are solid lamina that occupies substantial area between the blades creating an obstacle/hindrance for debris to flush out from the passage between the two consecutive blades. The cap has also a lubricating strip 10 formed or glued on it.

The cartridge of the present invention is depicted in FIG. 2*a*. The razor cartridge comprises of a multifunctional seat 114, plurality of blades (indicated by numerals 111, 112 and 113) and a multifunctional cap 110 obviating the use of spacers in between blades. The novel and inventive geometry and construction of the said multifunctional seat 114 in combination with a multifunctional cap 110 eliminates need of the spacers.

FIG. 2*b* depicts the section line position of the cartridge used for this sectional view that is used in FIG. 8 to illustrate debris flow path.

FIG. 3 depicts the details of the said multifunctional seat 114. It comprises of a substantially rectangular shaped platform 300. It has substantially flat surface 30 which is contoured due to rectangular openings 31, 33, 34 and 36 which are in longitudinal direction and rectangular openings 32 and 35 which are in transverse direction, they provide passage for flushing of debris. The said flat surface 30 is the first seat for the first blade 111.

A selective seat for the second blade 112 is in the form of a first set of the first protrusion 350, second protrusion 351, third protrusion 352, fourth protrusion 353, fifth protrusion 354 and sixth protrusion 355 as illustrated in FIG. 3. The surface of the blade 112 rests on the surface of these protrusions and a firm support is provided to the blade 112. These second set protrusions are for the second blade 112 are at a predefined vertical distance from the said first seat surface 30. This construction enables maintain distance between the said first blade 111 and the second blade 112 obviating the use of the conventional spacer. The first protrusion 350 of the said set of the second seat is disposed around a hole 360 which is used to receive multifunctional cap stacking pin of the multifunctional cap. The said protrusion 350 is in the form of a block disposed on the circumference of the said hole 360 following the contour of the said hole and profiled accordingly on one of the sides as depicted in the FIG. 3.

In one of the embodiments the occupied total surface area (footprint) area by all the said protrusions (the said set of the first protrusion 350, second protrusion 351, third protrusion 352, fourth protrusion 353, fifth protrusion 354 and sixth protrusion 355) on the surface of the platform 300 is of the order of 40% of the total surface area of the said surface of the platform 300.

In yet another embodiment there is a minimum of 60% available surface area (30) of the said platform 300 between the said protrusions 350 and 351, 351 and 352, protrusions 352 and 353.

In yet another embodiment, minimum 5% clamping area for second blade 112, and up to 85% clamping area for first 111 and third blade 113.

In another embodiment the said protrusions are of semi-rectangular, oval, flat oval, any other polygonal shaped geometry.

In another embodiment the vertical distance of protrusion 350, 351, 352, 353, 351, 355 from the surface of the platform 300 is in the range of 0.3 mm to 1 mm.

The said second protrusion 351 is disposed on the circumference of the second hole 361. The height vertical distance from the said surface 30 of the said second protrusion 351 is equal to vertical distance from the surface 30 that of the said first protrusion 350. The said second protrusion 351 is in the form of a block disposed on the circumference of the said hole 361 following the contour of the said hole and profiled accordingly on one of the sides as depicted in the FIG. 3 and FIG. 3A. The said third protrusion 352 is disposed on the circumference of the third hole/opening 362. The height/vertical distance from the said surface 30 of the said third protrusion 352 is equal to that of the vertical distance from the surface of the said first protrusion 350 and second protrusion 351. The horizontal seat surface area available for resting of the said second blade for the said second protrusion 351 and the said third protrusion 352 is equal. The said third protrusion 352 is disposed on the circumference of the third hole 362. The vertical distance from the said surface 30 of the said third protrusion 352 is equal to that of the vertical distance from the surface 30 of the said first protrusion 350 and second protrusion 351. The horizontal seat surface area available for resting of the said second blade for the said second protrusion 351 and the said third protrusion 352 is preferably equal.

The ratio of this surface area (available for resting of the said second blade) of the said first protrusion 350 and the said second protrusion 351 is in the range of 1:2 to 1:4. The ratio of the total surface area offered by the said second seat for the second blade 112 (in the form of a set of the first protrusion 350, second protrusion 351, third protrusion 352, fourth protrusion 353, fifth protrusion 354 and sixth protrusion 355) to the surface area of the first seat surface 30 is in the range of 0.08:1 to 0.06:1. The said fourth protrusion 353 is disposed on the circumference of the fourth opening 363. The vertical distance from the said surface 112 of the said fourth protrusion 353 is equal to that of the vertical distance from the surface 112 of the said first protrusion 350, second protrusion 351 and the third protrusion 352. The horizontal seat surface area available for resting of the said second blade for the said first protrusion 350 and the said fourth protrusion 353 is preferably equal. To this to avoid cantilever effect, fifth protrusion 354 and sixth protrusion 355 are placed on either side of platform 300. The horizontal seat surface area of protrusion 354 and 355 are preferably equal.

A selective seat for the third blade 113 is in the form of a second set of the first protrusion 450, second protrusion 451, third protrusion 452, fourth protrusion 453, fifth protrusion 454 and sixth protrusion 455 as illustrated in FIG. 3 and FIG. 3A.

The vertical distance from the said first seat 30 to third seat for the third blade 113 is in the form of a set of the first protrusion 450, second protrusion 451, third protrusion 452 fourth protrusion 453, fifth protrusion 454 and sixth protrusion 455 is greater than that height of the second seat for the second blade 112 that is in the form of a set of the first protrusion 350, second protrusion 351, third protrusion 352, fourth protrusion 353, fifth protrusion 354 and sixth protrusion 355.

The surface of the blade 113 rests on the surface of these protrusions and a firm support is provided to the blade 113. These second set protrusions are for the third blade 113 are at and predefined vertical distance 0.8 mm to 2 mm from the said first seat surface 30. This construction enables maintain distance between the said second blade 112 and the third blade 113 obviating the use of the conventional spacer. The first protrusion 450 of the said set of the second seat is disposed around a hole 360 which is used to receive multifunctional cap stacking pin 70. The said first protrusion 450 is in the form of a block disposed on the circumference of the said hole 360 following the contour of the said hole and profiled accordingly on one of the sides as depicted in the FIG. 3. The vertical distance from the said first seat 30 of the said first protrusion 450 is in a manner to enable appropriate distance 0.4 mm to 1 mm between the said third blade 113 and second blade 112.

The said second protrusion 451 is disposed on the circumference of the second hole 361. The vertical distance from the said surface 30 of the said second protrusion 451 is equal to that of the vertical distance of the said first protrusion 450 from the surface 30 of the said first protrusion. The said second protrusion 451 is in the form of a block disposed on the circumference of the said hole 361 following the contour of the said hole and profiled accordingly on one of the sides as depicted in the FIG. 3.

The said third protrusion 452 is disposed on the circumference of the third hole 362. The vertical distance from the said surface 30 of the said third protrusion 452 is equal to that of the vertical distance from the surface 30 of the said first protrusion 450 and second protrusion 451. The horizontal seat surface area available for resting of the said third blade for the said second protrusion 451 and the said third protrusion 452 is equal. The said third protrusion 452 is disposed on the circumference of the third hole 362. The vertical distance from the said surface 30 of the said third protrusion 452 is equal to that of the vertical distance from the surface 30 of the said first protrusion 450 and second protrusion 451. The horizontal seat surface area available for resting of the said third blade for the said second 30 protrusion 451 and the said third protrusion 452 is preferably equal. In addition to this to avoid cantilever effect protrusion 454 and 455 are placed on either side of platform 300.

The ratio of this surface area (available for resting of the said second blade) of the said first protrusion 450 and the said second protrusion 451 is in the range of 1:2 to 1:4 The ratio of the total surface area offered by the said third seat for the third blade 113 (in the form of a set of the first protrusion 450, second protrusion 451, third protrusion 452, fourth protrusion 453, fifth protrusion 454 and sixth protrusion 455) to the surface area of the first seat surface 30 is in the range of 0.08:1 to 0.06:1.

The said fourth protrusion 453 is disposed on the circumference of the fourth hole/opening 363. The vertical distance from the said surface 30 of the said fourth protrusion 453 is equal to that of the vertical distance from the surface 30 of the said first protrusion 450, second protrusion 451 and the third protrusion 452. The horizontal seat surface area available for resting of the said third blade for the said first protrusion 450 and the said fourth protrusion 453 is preferably equal. The horizontal seat surface area of protrusion 454 and 455 are preferably equal.

In one of the embodiments the said second seat for the second blade 112 which is in the form of a set of the first protrusion 350, second protrusion 351, third protrusion 352 fourth protrusion 353, fifth protrusion 354 and sixth protrusion 355 is attached to the said platform 300.

The skin resting and supporting guard 50 is disposed longitudinally as shown in FIG. 3. Part 50 is attached to seat 114 and provides rough surface to hold and stretch the skin to give plain skin surface for shaving. This also controls the exposure of the first blade.

Function of cavity 201 and 202 are to give location to locator protrusion 83 and 84 of multifunctional cap. Locator protrusion 83 & 84 and cavity 201& 202 is having bearing fit.

FIG. 3A illustrates side view of the said multifunctional seat 114 that depicts the clamps 500 and 501 provide beneath the said rectangular shaped platform 300. These protrusions receive the clamping arrangement of handle.

As depicted in FIG. 4, the first blade 111 comprises of the first set of apertures 111*a*, 111*b*, 111*c*, 111*d*, 111*k* and 111*n* that coincide and provides an opening to receive the said second set of seats (protrusions 350, 351, 352, 353, 354 and 355), second set of seats (protrusions 450, 451, 452, 453, 454 and 455) as well as holes 360, 361, 362, 363. There are further openings 111*e*, 111*f*, 111*g*, 111*h*, 111*i* and 111*j* provided longitudinally to coincide with the said rectangular openings 31, 33, 34 and 36 to enable flow of debris. There are substantially rectangular slots 111*l*, 111*m*, provided on the width of the blade as shown in the FIG. 4. Function of these slots are to locate the blade in multifunctional cap locator protrusions 83 and 84. The said blade 111 comprises of a longitudinal cutting edge 111*p*.

FIG. 5 depicts the said second blade 112. It comprises of the first set of apertures 112*a*, 112*b*, 112*c*, 112*d*, 112*n* and 112*k* that coincide and provides an opening to receive the said second set of seats (protrusions 350, 351, 352, 353, 354 and 355), second set of seats (protrusions 450, 451, 452, 453, 454 and 455) as well as the holes 360, 361, 362, 363. There are further openings 112*e*, 112*f*, 112*g*, 112*h*, 112*i* and 112*j* provided longitudinally to coincide with the said rectangular cavities/openings 31, 33, 34 and 36. There are substantially rectangular slots 112*l*, 112*m* provided on the width of the blade as shown in the FIG. 5. Function of these slots are to locate the blade in multifunctional cap locator protrusion 83 & 84, further these (112*l*, 112*m*) slots are preferably of same dimension as that of 111*l* and 111*m*. The said blade 112 comprises of a longitudinal cutting edge 112*p*.

FIG. 6 depicts the said third blade 113. It comprises of the first set of apertures 113*a*, 113*b*, 113*c* and 113*d* that coincide and provides an opening to receive the said second set of seats (protrusions 350, 351, 352, 353, 354 and 355), second set of seats (protrusions 450, 451, 452, 453, 454 and 455). There are substantially rectangular slots 113*e* and 113*f* provided on the width of the blade as shown in the FIG. 6.

Function of these slots are to locate the blade in multifunctional cap locator protrusion 83 and 84, further these (113*e*, 113*g*) slots are preferably of same dimension as that of 112*l* and 112*m*. The said blade 113 comprises of a longitudinal cutting edge 113*p*.

FIG. 7 depicts the multifunctional cap 110. It comprises of a set of stacking pins; first pin 70, second pin 71, third pin 72 and fourth pin 73. It has substantially flat 30 surface 74 on which the stacking pins are placed. The protrusion 75, 76, 77 and 78 are provided around the stacking pin 70, 71, 72, and 73 pins to provide support to blades.

Protrusions 75 and 78 are of same geometry and equal vertical distance from surface 74 preferably 0.5 to 2 mm. Protrusions 76 and 77 are of same geometrical shape and also equal vertical distance as that of 75 and 78. There are steps 79, 80, 81 and 82 are integral part of protrusions 75, 76, 77, and 78. The vertical distance of steps 79, 80, 81 and 82 is in the range of 0.3 to 1 mm. Geometrical shape of steps 79 and 82 is preferably same. Geometrical shape of 80 and 81 are preferably same.

The third blade 113 is placed on the surface 74. The second blade 112 is placed on the steps 79, 80, 81, 82. The first blade 111 is placed on surface of protrusion 75, 76, 77 and 78.

Ratio of surface area 74 to the surface area created by steps 79, 80, 81, 82 is about 10:1. Ratio of surface area 74 to the surface area of protrusion 75, 76, 77, 78 is about 15:1.

The multifunctional cap contains locator protrusions 83 and 84. Rectangular slots of the blades 113*e*, 113*g*, 112*l*, 112*m*, 111*l* and 111*m* get located on locator protrusion 83 and 84. Further these pips get located in cavity 201 and 202 of seat 114. This arrangement ensures the placement of blade with each other.

FIG. 8 depicts cross sectional view of the assembly illustrating the debris flow path. FIG. 2*b* depicts the section line position of the cartridge used for this sectional view. The debris flow path for the said blade 111 is indicated by the flow path line "a". The debris flow for the said blade 112 is indicated by line "b" between second blade 112 and first blade 111. As shown in the FIG. 8, "e" is additional debris flow path between the second and first blade. The flow line indicating "c" is the debris flow path between the third blade 113 and the second blade 112 passing through the first blade and the seat. The path indicated by "d" is the additional debris flow path between the third blade 113 and the second blade 112.

In yet another variation, a shaving aid or lubrication applicator 115 is affixed or included with the blade cartridge. Typically, as depicted in FIG. 2, the multifunctional cap 110 comprises a polystyrene-polyethylene oxide blend in the form of lubricating strip 115, which may be affixed to the upper surface of the multifunctional cap 110. During shaving, the polyethylene oxide bleaches out of the styrene matrix. The multifunctional cap member 110 may have a moulded lube strip 115 glued on or the lube strip 115 may be moulded onto the multifunctional cap member 110 in a second shot.

In yet another embodiment the said second seat for the second blade 112 which is in the form of a set of the first protrusion 350, second protrusion 351, third protrusion 352, fourth protrusion 353, fifth protrusion 354 and sixth protrusion 355 is made of a compressible material enable height adjustment and floating configuration. In another variant of this embodiment the said protrusions have height adjustable provision.

In yet another embodiment the third seat for the third blade 113 which is in the form of a set of the first protrusion 450, second protrusion 451, third protrusion 452 and fourth protrusion 453 fifth protrusion 454 and sixth protrusion 455 is made of a compressible material to enable height adjustment and floating configuration. In another variant of this embodiment the said protrusions have height adjustable provision.

In one of the embodiments of the invention the said multifunctional seat 114 is integrated with a handle.

In another embodiment of the invention the said multifunctional seat 114 is attachable to a handle.

In yet a further variation, the blade cartridge may be permanently or detachably connected to a handle by suitable structures 500 and 501 formed on the bottom surface of the multifunctional seat 114.

In another embodiment, there are more than two blades disposed and have respective seats provided in the said multifunctional seat 114.

It is evident that the geometrical configuration of the multifunctional seat and multifunctional cap with the protrusions for the respective seats obviate use of spacers.

We claim:

1. A razor cartridge comprising:

a multifunctional seat, a multifunctional cap and a plurality of blades comprising a first blade, a second blade, and a third blade;

the multifunctional seat comprising, a rectangular shaped platform comprising a flat surface and a set of holes, wherein the flat surface is configured to be a first seat for the first blade;

a first set of protrusions radially configured around the set of holes of a first height configured to be a second seat for the second blade;

a second set of protrusions radially configured around the set of holes of a second height configured to be a third seat for the third blade;

a third set of protrusions at the first height on the flat surface placed at a first end and at a second end of a longitudinal direction of the multifunctional seat;

a fourth set of protrusions at the second height on the flat surface placed at the first end and at the second end of the longitudinal direction of the multifunctional seat;

the multifunctional cap comprising, a set of stacking pins configured to be received by the set of holes of the multifunctional seat;

a fifth set of protrusions radially configured around the set of stacking pins at a third height and configured to align with the third set of protrusions of the multifunctional seat;

a sixth set of protrusions radially configured around the set of stacking pins at a fourth height and configured to align with the fourth set of protrusions of the multifunctional seat;

wherein the first blade, the second blade, and the third blade are each provided with a set of apertures and are configured such that the first blade is received by the first seat, the second blade is received by the second seat, and the third blade is received by the third seat; and wherein the first blade, the second blade, and the third blade are held in position on the multifunctional seat and the multifunctional cap by matching the set of holes with the set of stacking pins, the first set of protrusions matching with the fifth set of protrusions, and the second set of protrusions matching with the sixth set of protrusions; and wherein the said multifunctional seat in combination with the multifunctional cap is configured to obviate a need for spacers.

2. The razor cartridge of claim 1, wherein the third set of protrusions configured to be the second seat for the second blade and the fourth set of protrusions are configured to be the third seat for the third blade.

3. The razor cartridge of claim 1, wherein the multifunctional seat further comprising a first cavity placed at the first end of the longitudinal direction of the multifunctional seat and a second cavity placed at the second end of the longitudinal direction of the multifunctional seat.

4. The razor cartridge of claim 3, wherein the multifunctional cap further comprising a first location pip that is configured to align with the first cavity of the multifunctional seat and a second location pip that is configured to align with the second cavity of the multifunctional seat.

5. The razor cartridge of claim 4, wherein the first location pip when aligned and assembled with the first cavity of the multifunctional seat and the second location pip when aligned and assembled with the second cavity of the multifunctional seat are configured to have a bearing fit.

6. The razor cartridge of claim 1, wherein the flat surface of the rectangular shaped platform is contoured to have a first set of rectangular openings that are in the longitudinal direction and a second set of rectangular openings that are in a transverse direction of the multifunctional seat configured to provide passage for flushing of debris.

7. The razor cartridge of claim 1, wherein the set of holes, the first set of protrusions, the second set of protrusions are equal in number.

8. The razor cartridge of claim 1, wherein the first set of protrusions comprises a first protrusion, a second protrusion, a third protrusion, and a fourth protrusion on the rectangular shaped platform; the second set of protrusions comprises a fifth protrusion, a sixth protrusion, a seventh protrusion, and an eighth protrusion on the rectangular shaped platform; the set of holes comprises a first hole, a second hole, a third hole, and a fourth hole on the rectangular shaped platform; and the first set of protrusions and the second set of protrusions are in a form of a block disposed along circumference of the set of holes following contour and profiled accordingly.

9. The razor cartridge of claim 8, wherein a first top surface area available for resting of the second blade on the second protrusion and the third protrusion is equal; and wherein a second top surface area available for resting of the second blade on the first protrusion and the fourth protrusion is equal, wherein the first protrusion, the second protrusion, the third protrusion, and the fourth protrusion are in series from the first end of the longitudinal direction to the second end of the longitudinal direction.

10. The razor cartridge of claim 8, wherein a third top surface area available for resting of the third blade on the sixth protrusion and the seventh protrusion is equal; and wherein a fourth top surface area available for resting of the third blade on the fifth protrusion and the eighth protrusion is equal, wherein the fifth protrusion, the sixth protrusion, the seventh protrusion, and the eighth protrusion are in series from the first end of the longitudinal direction to the second end of the longitudinal direction.

11. The razor cartridge of claim 8, wherein a surface area of the first protrusion to a surface area of the second protrusion is in a range of 1.2 to 1.4.

12. The razor cartridge of claim 1, wherein a top surface area of the third set of protrusions and a top surface area of the fourth set of protrusions are equal.

13. The razor cartridge of claim 1, wherein the second height is greater than the first height.

14. The razor cartridge of claim 1, wherein the fourth height is greater than the third height.

15. The razor cartridge of claim 1, wherein the first blade comprises a first set of apertures configured to align with the first set of protrusions, the second set of protrusions and the set of holes; a second set of apertures configured to align with a first set of rectangular openings formed in the flat surface to enable flow of shaving debris; a first set of slots along a transverse direction of the first blade configured to align the first blade with the third set of protrusions and the fourth set of protrusions; and a second set of slots configures to align with a first cavity and a second cavity of the multifunctional seat.

16. The razor cartridge of claim 1, wherein the second blade comprises a set of apertures configured to align with the first set of protrusions; the second set of protrusions and the set of holes; a first set of slots along a transverse direction of the second blade configured to align the second blade with the fourth set of protrusions; and a second set of slots configures to align with a first cavity and a second cavity of the multifunctional seat.

17. The razor cartridge of claim 1, wherein the third blade comprises of a set of apertures configured to align with the first set of protrusions; the second set of protrusions and the set of holes; and a set of slots along a transverse direction of the third blade configured to align the third blade with a first cavity and a second cavity of the multifunctional seat.

18. The razor cartridge of claim 1, wherein the set of stacking pins comprises a first pin, a second pin, a third pin, and a fourth pin.

19. The razor cartridge of claim 1, wherein the third height is in a range of 0.5 mm to 2 mm.

20. The razor cartridge of claim 1, wherein the multifunctional cap comprising the set of stacking pins further comprises a supporting flat surface and a seventh set of protrusions of a fifth height wherein the fifth height is in a range of 0.3 mm to 1 mm.

21. The razor cartridge of claim 20, wherein a first ratio of an area of the supporting flat surface to a seventh top surface area created by the seventh set of protrusions is 10 to 1.

22. The razor cartridge of claim 21, wherein a second ratio of a first surface area of the supporting flat surface to a second surface area of the fifth set of protrusions is 15 to 1.

23. The razor cartridge of claim 1, wherein the multifunctional cap comprises a lubricating strip comprising a polystyrene-polyethylene oxide blend in a hydrodynamic form.

24. The razor cartridge of claim 1, wherein the first set of protrusions are made of a compressible material to enable height adjustment and floating configuration.

25. The razor cartridge of claim 1, wherein the second set of protrusions are made of a compressible material to enable height adjustment and floating configuration.

26. The razor cartridge of claim 1, wherein the third set of protrusions are made of a compressible material to enable height adjustment and floating configuration.

27. The razor cartridge of claim 1, wherein the fourth set of protrusions are made of a compressible material to enable height adjustment and floating configuration.

28. The razor cartridge of claim 1, wherein the razor cartridge is permanently connected to a handle.

29. The razor cartridge of claim 1, wherein the razor cartridge is detachably connected to a handle.

30. The razor cartridge of claim 1, wherein the plurality of blades comprises at least the first blade, the second blade and the third blade.

* * * * *